United States Patent [19]

Hargrove

[11] 4,332,185

[45] Jun. 1, 1982

[54] RELOADING PRESS PRIMING ARM LOADER AND ACTUATOR

[76] Inventor: Jasper E. Hargrove, 2012 Alice St., Waycross, Ga. 31501

[21] Appl. No.: 142,768

[22] Filed: Apr. 22, 1980

[51] Int. Cl.[3] ..... F42B 33/10

[52] U.S. Cl. ..... 86/36; 86/23

[58] Field of Search ..... 86/23, 28, 33, 36, 37

[56] References Cited

U.S. PATENT DOCUMENTS

| | | | |
|---|---|---|---|
| 2,865,244 | 12/1958 | Doyle | 86/36 |
| 3,138,055 | 6/1964 | Weston | 86/36 |
| 3,283,643 | 11/1966 | Mittelsteadt | 86/36 |

*Primary Examiner*—Stephen J. Lechert, Jr.
*Attorney, Agent, or Firm*—Harvey B. Jacobson

[57] ABSTRACT

A lost motion connection structure is provided between an oscillatable reloading press handle and the oscillatable primer arm of the press and is operative to automatically swing the primer arm of the press between primer pickup and primer positioning positions during oscillation of the press handle to reciprocally shift the shell holder of the press between the die sizing and primer press positions thereof. The lost motion connection structure is fully adjustable whereby the position of the primer arm in the primer pickup position thereof may be adjusted according to the positioning of an associated primer tube and includes lost motion structure whereby the primer arm may be swung to the primer positioning position during initial movement of the shell holder from the die sizing position toward the primer press position.

8 Claims, 4 Drawing Figures

RELOADING PRESS PRIMING ARM LOADER AND ACTUATOR

BACKGROUND OF THE INVENTION

Various forms of reloading presses heretofore have been designed such as those disclosed in U.S. Pat. Nos. 723,838, 2,794,359, 2,865,244, 3,138,055 and 3,283,643.

The reloading presses disclosed in U.S. Pat. Nos. 2,865,244 and 3,138,055 as well as the Model 3 Supertool reloader marketed by Herter's Inc., of Waseca, Minn., include oscillatable and reciprocal components similar to those found in the reloading press of the instant invention. The reciprocal components include rectilinearly reciprocal shell holders and the oscillatable components include oscillatable actuating handles and primer arms. These previously known forms of reloading presses are effective in rapidly installing new primers, but require four manual steps including (1) insertion of a shell to be primed, (2) pivoting of the primer arm from a primer pickup position to a primer press position, (3) oscillation of an actuating handle and (4) removal of the primed case. The improved reloading press of the instant invention requires only three manual steps of the operator of the press, inasmuch as oscillation of the primer arm between the primer pickup and primer positioning positions thereof is automatically accomplished during oscillation of the actuating handle of the press.

BRIEF DESCRIPTION OF THE INVENTION

The reloading press of the instant invention is constructed in a manner whereby the operation thereof is greatly simplified and may be effected more quickly with less chance of error on the part of the operator. The improved reloading press includes structure whereby oscillation of the primer arm between the primer pickup and primer positioning positions is automatically effected during oscillation of the press actuating handle between the extreme limits of oscillation thereof.

The main object of this invention is to provide a reloading press which will enable the operator of the press to more quickly and efficiently perform reloading operations.

Another object of this invention is to provide a reloading press which will be operative in a manner to eliminate one manual step of the operator of a conventional reloading press and to thereby eliminate the possibility of human error usually associated with such a manual step.

Another important object of this invention is to provide an attachment for existing conventional reloading presses which may be readily attached thereto and utilized to convert conventional reloading presses for function in accordance with the present invention.

A final object of this invention to be specifically enumerated herein is to provide an improved form of reloading press which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
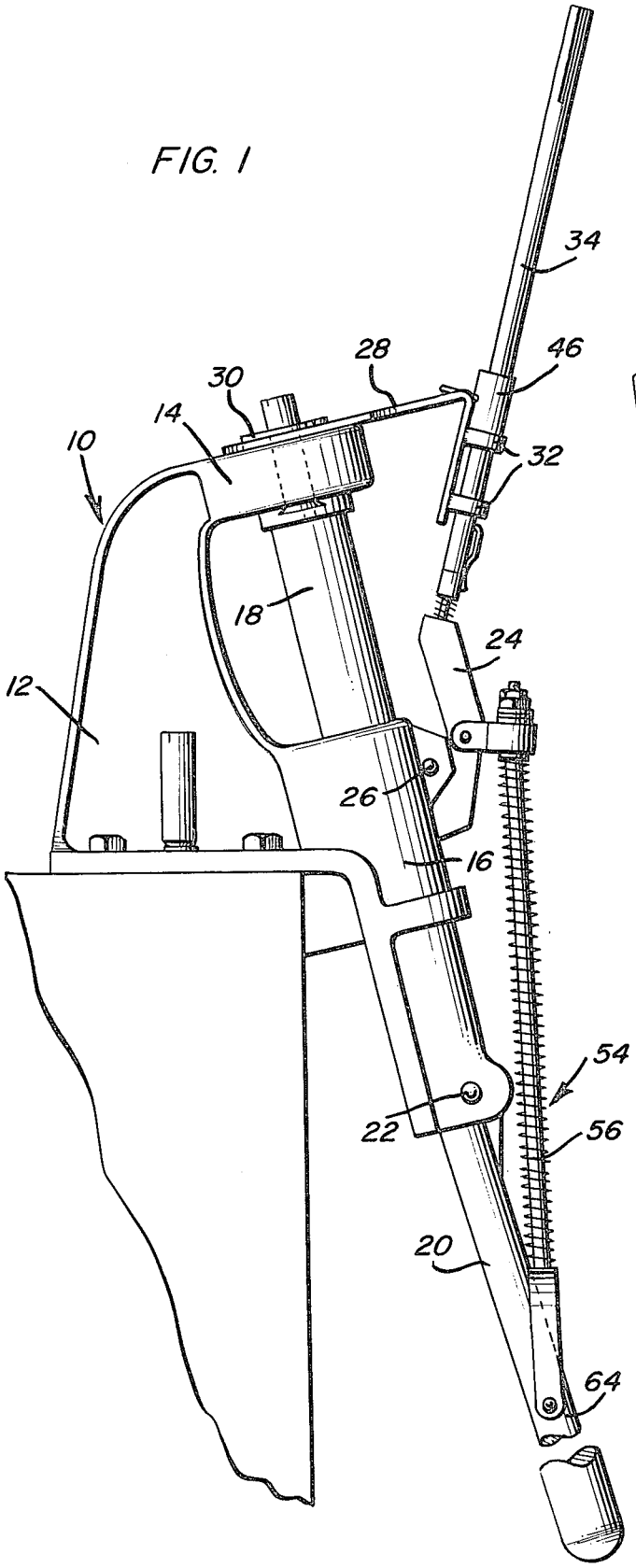
FIG. 1 is a side elevational view of a conventional form of reloading press modified in accordance with the present invention.
Figure 4:
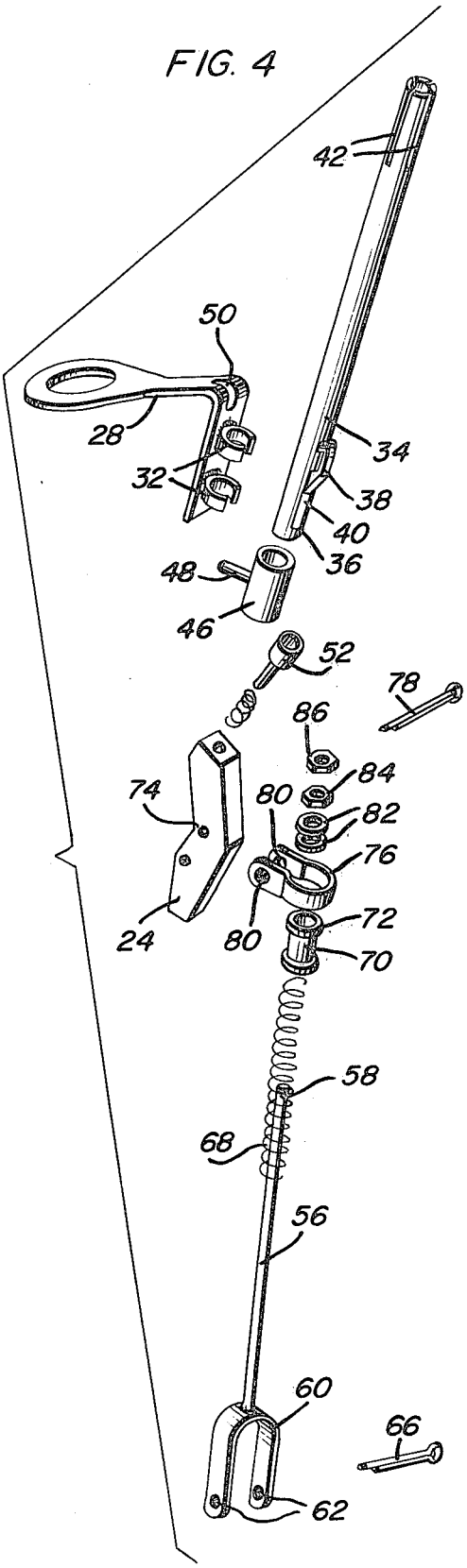
FIG. 4 is an exploded perspective view of a modified primer arm and other components which may be attached to a conventional reloading press in order to modify the latter in accordance with the present invention.

Referring now more specifically to the drawings, the numeral 10 generally designates a conventional form of reloading press, such as the Herter Model 3 marketed by Herter's Inc. Waseca, Minn. The press 10 includes a C-shaped base 12 including upper and lower axially aligned sleeve portions 14 and 16. A longitudinally slotted cylindrical shell holder 18 is reciprocally supported in the lower sleeve portion 16 and a press handle or lever 20 is oscillatably supported from the sleeve portion 16 as at 22 and is operatively connected to the shell holder 18 for raising and lowering the latter in response to lowering and raising of the free lower end of the handle 20.

Figure 3:
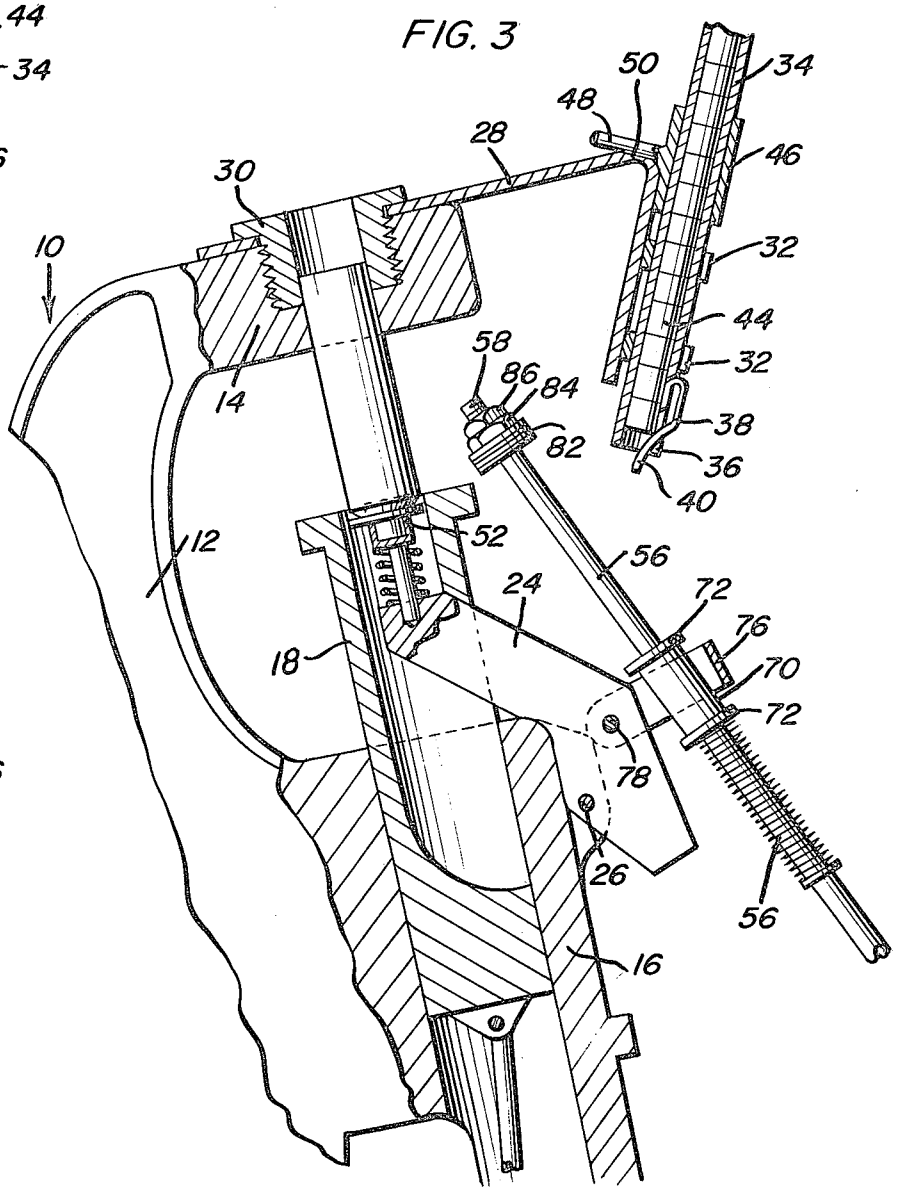
FIG. 3 is an enlarged fragmentary vertical sectional view similar to FIG. 2, but illustrating the reciprocal and oscillatable components of the press in still further different positions of operation.
Figure 2:
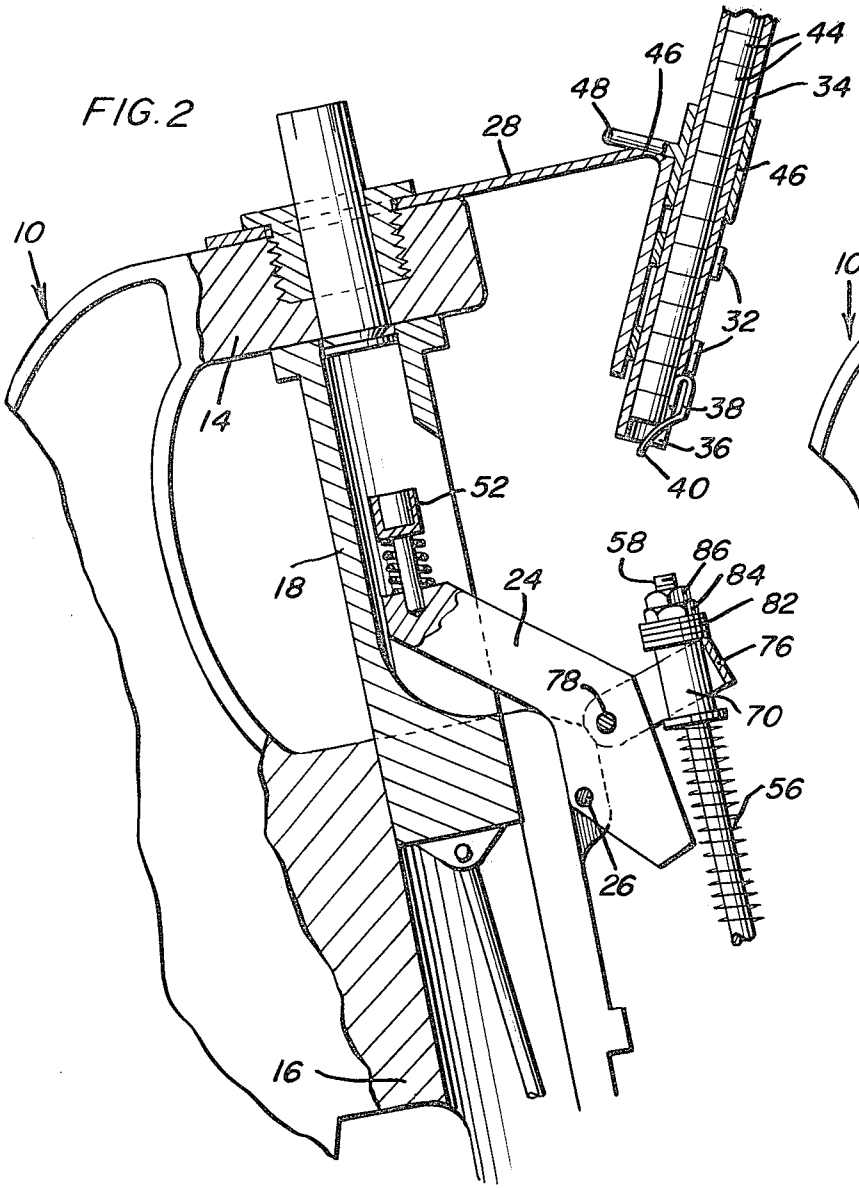
FIG. 2 is a fragmentary enlarged vertical sectional view illustrating some of the oscillatable and reciprocal components of the press illustrated in FIG. 1 in different positions of oscillation.

A primer arm 24 is oscillatably supported from the sleeve portion 16 as at 26 for movement between the primer pickup and primer press positions thereof illustrated in FIGS. 1 and 3 and a primer tube support bracket 28 is supported from the upper sleeve portion 14 by a threaded reducing bushing 30.

The foregoing comprises a description of the aforementioned Model 3 reloading press marketed by Herter's Inc. Although the Model 3 does not include the equivalent of the primer tube support bracket 28, primer tube support brackets heretofore have been provided such as those disclosed in U.S. Pat. Nos. 2,865,244 and 3,138,055.

However, the primer tube support bracket 28 is unique in that it includes a pair of split sleeve portions 32 supported therefrom into which the lower end of a primer tube 34 may be inserted. The lower end of the primer tube 34 is longitudinally slotted as at 36 and includes a leaf spring 38 mounted thereon including a free end 40 which projects into the slot 36. The upper end of the tube 34 is slotted as at 42 and slightly constricted whereby the tube 34 may be utilized to pickup primers 44, see FIG. 3, when the tube 34 is in inverted position.

A height adjustment collar 46 is frictionally slidably engaged over the tube 34 and includes a radially outwardly projecting pin 48 seatable in a slot 50 formed in the support bracket 28. In this manner, the height adjustment collar 46 may be shifted along the tube 34 and rotated relative thereto to the desired position with the pin 48 disposed in the slot 50 when the slot 36 opens away from the shell holder 18. The primer arm 24 is conventional in that it supports a primer cup 52 therefrom of substantially the same inside diameter as the primer tube 34.

However, a connection structure referred to in general by the reference numeral 54 is provided and establishes an operative connection between the handle 20 and the primer arm 24. The connection structure 54 includes an elongated rod 56 externally threaded on one end as at 58 and including a clevis 60 on its other end. The free ends of the arms of the clevis 60 are provided with aligned apertures 62 and the free end portion 64 of the handle 20 has a diametric bore formed therethrough and the clevis 60 is pivotally connected to the free end portion 64 through the utilization of a cotter pin 66 or other pivot fastener passed through the apertures 62 and the diametric bore formed in the free end portion 64 of the handle 20. A compression spring 68 is telescoped over the threaded upper end of the rod 56 and a sleeve 70 is thereafter telescoped downwardly over the upper end of the rod 56 and includes opposite end radially enlarged circumferential shoulders 72. The primer arm 24 is provided with a transverse bore 74 and a clevis-type clamp 76 is engaged about the sleeve 70 between the shoulders 72 and pivotally anchored to the midportion of the primer arm 24 by a cotter pin 78 passed through the aligned apertures 80 in the free ends of the arms of the clamp 76 and the bore 74. A pair of washers 82 are passed over the upper end of the rod 56 above the sleeve 70 and an adjusting nut 84 and lock nut 86 are threaded on the upper end of the rod 56 above the washers 82.

In operation, the primer tube 34 is utilized to contain a plurality of primers 44 and the height adjustment collar 46 is mounted on the tube in the approximate position thereof illustrated in FIG. 1. The primer tube 34 then has its lower end inserted downwardly through the split sleeve portions 32 with the pin 48 of the height adjustment collar 46 seated in the slot 50 formed in the bracket 28. Proper positioning of the tube 34 will then enable the cup 52 supported from the upper free end of the primer arm 24 to swing into position immediately below the lower end of the tube 34 in the manner illustrated in FIG. 1 of the drawings, whereby the cup 52 will outwardly deflect the lower free end 40 of the leaf spring 38 and release the lowermost primer 44 for downward movement into the cup 52, the next uppermost primer 44 having its lower end projecting slightly below the lower end of the tube 34. As the primer arm 24 is swung in a counterclockwise direction from the position thereof illustrated in FIG. 1, the cup 52 moves to the left and enables the free end 40 of the spring 38 to engage the lowermost primer 44 and retain all of the primers 44 remaining in the tube stationary.

The adjusting nut 84 is adjusted such that when the handle 20 is in the lowermost position thereof illustrated in FIG. 1 of the drawings, the cup 52 supported from the primer arm 24 will be properly registered with the lower end of the primer tube 34.

Operation of the reloading press 10 may then be readily accomplished. Initially, after the adjusting nut 84 has been adjusted as desired and the lock nut 86 has been tightened, the press handle 20 is raised to begin the priming stroke. As the handle 20 is initially raised (swung counterclockwise as illustrated in FIG. 1), the primer arm 24 rotates in a counterclockwise direction to swing the primer supporting cup 52 toward the shell holder 18. However, continued upward swinging movement of the free end portion 64 of the handle 20 lowers the shell holder 18 sufficiently to enable a shell to be supported from the upper end of the shell holder. Thereafter, further upward movement of the free end portion 64 of the handle 20 causes the primer arm 24 to be seated within the slot of the shell holder 18 and the shell holder 18 to move downwardly relative to the stationarily positioned primer supporting cup 52 in order that the primer supported therefrom may be readily inserted in the shell. After the shell has been primed, the handle 20 is lowered enough to permit removal of the primed shell and the next unprimed shell is picked up and placed in position on the shell holder. Thereafter, the press handle is lowered fully thereby swinging the primer arm 24 back to the position thereof illustrated in FIG. 1 whereby the lowermost primer 44 in the tube 34 is released and deposited in the cup 52. Of course, the handle 20 is then again raised to complete the shell priming process.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a reloading press of the type including a base and a shell holder reciprocal relative to the base between a first die sizing position and a second primer press position, a handle oscillatable relative to the base between first and second positions and connected to the shell holder for movement of the shell holder to the first and second positions thereof responsive to movement of the handle to its first and second positions, respectively, a primer arm oscillatable relative to the base between a first primer pickup position and a second primer positioning position, a primer tube supported from the base for feeding successive primers to said primer arm as said arm is successively moved to the first position thereof, yieldable lost motion connecting means operatively connecting said handle to said primer arm for swinging the latter to its first and second positions responsive to movement of said handle to its first and second positions, respectively.

2. The combination of claim 1 wherein said shell holder is shiftable to a shell release position intermediate said die sizing and primer press positions, said yieldable lost motion connecting means being operative to swing said primer arm from said primer pickup position to said primer positioning position during movement of said handle to shift said shell holder from said die sizing position toward said shell release position.

3. The combination of claim 1 wherein said primer arm includes a free end portion swingable relative to said primer tube, a primer receiving cup supported from said free end of said arm and swingable into position in registry with one end of said primer tube, said handle and base including coacting means limiting swinging movement of said handle in one direction to said second position, said lost motion connecting means including adjustment structure whereby angular displacement of said arm relative to said base to precisely register said cup with said end of said primer tube may be effected during final movement of said handle in said one direction toward the limit position of movement thereof.

4. The combination of claim 3 wherein said primer tube and cup include coacting structure whereby to automatically release the endmost primer within said tube for reception in said cup in response to registry of said cup with said one end of said tube.

5. The combination of claim 4 wherein said primer tube is disposed in upstanding position with said one end thereof lowermost said primer tube being adapted to slidingly receive a stack of primers therein, said coacting structure including a longitudinal slot formed in said one end of said tube and a leaf spring supported from said tube including a free end projecting into said slot and outwardly beyond said one end of said tube, said cup being engageable with said free end of said spring to flex the latter as said cup moves into registry with said one end of said primer tube.

6. The combination of claim 5 wherein said press includes a bracket supported from said base from which said primer tube is stationarily supported, said primer tube and base including coacting structure operative to adjustably longitudinally shift said primer tube relative to said bracket.

7. The combination of claim 6 wherein said bracket and primer tube includes coacting structure operative to adjustably angularly displace said primer tube about its longitudinal axis relative to said base.

8. A bracket for stationary support from a reloading press frame, a pair of aligned split sleeve portions supported from said bracket in vertically spaced relation, a primer tube slidably received through said split sleeve portions and frictionally gripped thereby for longitudinal and rotational adjustment of said primer tube relative to said split sleeve portions, said bracket defining an indexing detent, an adjustment collar frictionally and slidably and rotatably received on said primer tube, said collar including a radially outwardly extending projection seatingly receivable in said indexing detent, said tube being longitudinally and rotatably adjustable relative to said collar.

* * * * *